US009878865B2

(12) United States Patent
Kowalewski et al.

(10) Patent No.: US 9,878,865 B2
(45) Date of Patent: Jan. 30, 2018

(54) APPARATUS AND METHOD FOR SECURING AN END OF A STRIP TO A TAMBOUR

(75) Inventors: Wolfgang Kowalewski, Quebec (CA); Roman Caspar, Quebec (CA)

(73) Assignee: PAPRIMA INDUSTRIES, INC., Dorval (Montreal) (CA)

( * ) Notice: Subject to any disclaimer, the term of this patent is extended or adjusted under 35 U.S.C. 154(b) by 281 days.

(21) Appl. No.: 12/867,790

(22) PCT Filed: Feb. 19, 2009

(86) PCT No.: PCT/IB2009/005065

§ 371 (c)(1),
(2), (4) Date: Nov. 22, 2010

(87) PCT Pub. No.: WO2009/115915

PCT Pub. Date: Sep. 24, 2009

(65) Prior Publication Data

US 2011/0083795 A1 Apr. 14, 2011

(30) Foreign Application Priority Data

Feb. 20, 2008 (DE) ..... 10 2008 009 958

(51) Int. Cl.
*B29C 63/10* (2006.01)
*B65H 19/29* (2006.01)
(Continued)

(52) U.S. Cl.
CPC ..... *B65H 19/29* (2013.01); *B65H 19/265* (2013.01); *B65H 19/28* (2013.01);
(Continued)

(58) Field of Classification Search
CPC ..... B65H 19/265; B65H 19/28; B65H 19/29; B65H 2301/414421; B65H 2301/414433;
(Continued)

(56) References Cited

U.S. PATENT DOCUMENTS 1,739,381 A * 12/1929 Wood ..... B65H 19/102 156/157
5,782,426 A * 7/1998 Kinnunen ..... B65H 18/22 242/526.3
(Continued)

FOREIGN PATENT DOCUMENTS

DE 69620089 T2 8/2002
DE 10085234 T1 10/2002
(Continued)

OTHER PUBLICATIONS

English Translation—Voith Paper Patent GMBH; "Winding Machine for Transferring a Running Material Web." Publication Date: Sep. 6, 2004. International Code: DE 202004009144 U1. pp. 1-16.*
(Continued)

*Primary Examiner* — Philip Tucker
*Assistant Examiner* — Vicki Wu
(74) *Attorney, Agent, or Firm* — Leydig, Voit & Mayer, Ltd.

(57) ABSTRACT

A method for securing a web end of a paper web on a first drum during a change of drum, the method includes passing the web end through a nip between a Pope roller and the second drum and applying adhesive to an area of the web end on a downward-rotating area of the Pope roller after the web end is passed through the nip.

10 Claims, 5 Drawing Sheets

(51) Int. Cl.
*B65H 19/26* (2006.01)
*B65H 19/28* (2006.01)

(52) U.S. Cl.
CPC ..... *B65H 2301/414421* (2013.01); *B65H 2301/414433* (2013.01); *B65H 2301/414436* (2013.01); *B65H 2301/414443* (2013.01); *B65H 2301/46* (2013.01); *B65H 2301/51534* (2013.01); *B65H 2408/22* (2013.01); *B65H 2408/236* (2013.01)

(58) Field of Classification Search
CPC .... B65H 2408/236; B65H 2301/51534; B65H 2301/414436; B65H 2408/22; B65H 2301/46
USPC ..... 156/250
See application file for complete search history.

(56) References Cited

U.S. PATENT DOCUMENTS

| | | | | |
|---|---|---|---|---|
| 6,863,238 | B1 * | 3/2005 | Kojo et al. | 242/532.3 |
| 2004/0115403 | A1 * | 6/2004 | Eikmeier et al. | 428/192 |
| 2008/0149757 | A1 * | 6/2008 | Tiitta et al. | 242/532.3 |

FOREIGN PATENT DOCUMENTS

| | | | | |
|---|---|---|---|---|
| DE | 202004009144 | U1 | 8/2004 | |
| DE | 10309049 | A1 * | 9/2004 | B65H 19/267 |
| DE | 10343448 | A1 | 4/2005 | |
| EP | 0765832 | A2 | 4/1997 | |
| WO | WO 0138213 | A2 | 5/2001 | |

OTHER PUBLICATIONS

International Search Report for PCT/IB2009/005065 dated May 26, 2010.
German Patent Office, Office Action (Jul. 18, 2008).
U.S. Patent & Trademark Office, Written Opinion of the International Searching Authority in International Patent Application No. PCT/IB2009/005065 (dated May 26, 2010).
U.S. Patent & Trademark Office, International Preliminary Report on Patentability in International Patent Application No. PCT/IB2009/005065 (dated Aug. 26, 2010).
European Patent Office, Examination Report in European Patent Application No. 09721904.2 (dated Mar. 21, 2012).
State Intellectual Property Office of the Peoples Republic of China (Translation attached), First Notification of Office Action (dated Apr. 16, 2012).

* cited by examiner

APPARATUS AND METHOD FOR SECURING AN END OF A STRIP TO A TAMBOUR

CROSS REFERENCE TO PRIOR APPLICATIONS

This application is a U.S. National Phase Application under 35 U.S.C. § 371 of International Application No. PCT/IB2009/005065, filed Feb. 19, 2009, which claims priority to German Application No. DE 10 2008 009 958.9, filed Feb. 20, 2008. The International Application was published in German on Sep. 24, 2009 as WO 2009/115915 under PCT Article 21 (2).

FIELD

The invention relates to a device and a method for securing a web end on a drum. In particular, the invention relates to a method and a device for securing a free web end during a change of drum.

BACKGROUND

In the paper industry, paper webs are rolled onto a drum and stored thus. The problem arises that web ends can move freely in particular during a change of drum and thus tear free and possibly cause damage. For example, the web ends can unintentionally be wound with a different paper web onto a different drum, where it can lead to rejects being produced.

In DE 100 85 234 T1, a method and a device for change of reel are described, in which a paper web to be wound onto a bobbin core is moved, to form a lap, by at least the rotary force of the winding cylinder and the cleavage load, wherein in connection with the change of reel a new bobbin core is brought into nip contact with the winding cylinder together with a replacement device above the winding cylinder.

SUMMARY OF THE INVENTION

It is an aspect of the present invention to provide a device and a method which prevent web ends from coming loose.

In an embodiment, a method is provided for securing a web end (23) of a paper web on a first drum (11) during a change of drum from a first drum (11) onto a second drum (12), wherein the web end (23) passes between a Pope roller (10) and the second drum (12), has adhesive (2) applied to it and is wound onto the first drum (11).

The application of the adhesive preferably prevents a release of the existing tensile stress of the paper web after the separation, and a lateral displacement of the topmost layers of the paper web.

A web end is preferably the end of a fabric web, cardboard web or plastic web, particularly preferably the end of a paper web.

An adhesive is a product that is suitable for gluing paper webs together. Preferably, the adhesive comprises modified starch. Preferably, the adhesive can be dissolved again in the dissolver. Preferably, the adhesive is water-soluble. Preferably, the adhesive is suitable for gluing paper webs fast against each other quickly and with a long-term memory effect.

Preferably, the adhesive is applied to an area of the web end which has passed through a nip between the Pope roller and the second drum. The adhesive is thereby applied in such a way that the adhesive does not stick to the Pope roller.

Preferably, the adhesive is applied to an area of the web end which is located on a downward-rotating area of the Pope roller. The adhesive is thereby applied to the web end in such a way that it travels a short distance until the web end sticks on the first drum. This minimizes possible contamination.

Preferably, the adhesive (2) is applied to the area of the web end (23) at an angle of impact of 1° to 30°.

The angle of impact is equal to zero if the direction of movement of the adhesive (2) is the same as the direction of movement of the web end (23).

An angle of impact of 1° to 30° has the advantage that the second drum (12) is particularly well protected from being wetted with adhesive.

Preferably, the adhesive (2) is applied to the area of the web end (23) at an angle of impact of 150° to 179°. The web end is thereby particularly intensively wetted with adhesive.

Preferably, the adhesive (2) is applied to the area of the web end (23) at an angle of impact of 80° to 100°. The adhesive can thereby be applied particularly accurately to a specific area.

Preferably, the adhesive (2) is applied to the area of the web end (23) with a distance to the nip between the Pope roller (10) and the second drum (12) of $^{2}/_{360}$ to $^{90}/_{360}$ of the circumference of the Pope roller (10). A particularly large and stable adhesion surface thereby results.

Preferably, the adhesive (2) is applied to the area of the web end (23) with a distance to the nip between the Pope roller (10) and the second drum (12) of $^{2}/_{360}$ to $^{20}/_{360}$ of the circumference of the Pope roller (10). The adhesive can therefore be applied to the outermost end of the web end. A small part of the web is utilized for the adhesion surface.

Preferably, the adhesive (2) is applied to the area of the web end (23) with a distance to the nip between the Pope roller (10) and the second drum (12) of $^{70}/_{360}$ to $^{90}/_{360}$ of the circumference of the Pope roller (10). The risk of adhesive reaching the outside of the first drum (11) is thereby reduced.

Preferably, the adhesive (2) is applied to the area of the web end (23) with a distance to the nip between the Pope roller (10) and the second drum (12) of $^{30}/_{360}$ to $^{50}/_{360}$ of the circumference of the Pope roller (10). A compromise between the utilization of the web and the reduction of the risk of adhesive reaching the outside of the first drum (11) is thereby reached.

Preferably, the adhesive is applied to an area of the web end which is located between the first and second drums and/or on the first drum. It is thereby possible to position an adhesive applicator in many different areas, with the result that there is a large degree of freedom as regards the utilization of the overall space.

Preferably, the web end is produced by means of severing a web, the severing of the web comprising the introduction of a first separation mark and a second separation mark, wherein the first separation mark runs from a central area to a first outer edge of the web and the second separation mark runs from the central area to a second outer edge of the web. It is thereby possible to sever the web in such a way that small differences in tensile stress occur.

Preferably, the severing of the web is synchronized with the application of the adhesive. Preferably, the severing of the web is time-synchronized with the application of the adhesive. It is thereby possible to apply the adhesive only when it is needed. It is possible to apply the adhesive only to the web end. Preferably, the severing of the web is spatially synchronized with the application of the adhesive. It is thereby possible to apply the adhesive precisely to the spots where it is needed.

Preferably, the adhesive is applied along an outer edge and/or an inner edge and/or a separation front. Particularly preferably, the adhesive is applied along and at a distance from an outer edge and/or an inner edge and/or a separation front. The separation front preferably comprises a straight separation edge, particularly preferably a curved separation edge.

The object is also achieved by a device comprising a first drum, a second drum, a Pope roller and at least one adhesive applicator, wherein the second drum and the Pope roller form a nip and the adhesive applicator is positioned behind the nip in the direction of feed of the Pope roller and of the second drum. It is thereby possible to apply the adhesive in a simple way.

An adhesive applicator is a device which is suitable for applying adhesive to the paper web. Preferably, the applicator comprises a mechanical, particularly preferably a pneumatic, device. Preferably, the applicator has an injection or spray device. Particularly preferably, the applicator has a nozzle.

Preferably, the adhesive applicator (32) can be directed at an angle of 1° to 179° towards an area of the paper web passing through (20).

Preferably, the adhesive applicator (32) can be directed at an angle of 1° to 30° towards an area of the paper web passing through (20).

Preferably, the adhesive applicator (32) can be directed at an angle of 150° to 179° towards an area of the paper web passing through (20).

Preferably, the adhesive applicator (32) can be directed at an angle of 80° to 100° towards an area of the paper web passing through (20).

Preferably, the range of angles at which the adhesive applicator (32) can be directed towards an area of the paper web passing through (20) can be adjusted between 1° and 179°.

Preferably, the adhesive applicator (32) can be directed with a distance to the nip between the Pope roller (10) and the second drum (12) of $^{2}/_{360}$ to $^{90}/_{360}$ of the circumference of the Pope roller (10) towards an area of the paper web passing through (20).

Preferably, the adhesive applicator (32) can be directed with a distance to the nip between the Pope roller (10) and the second drum (12) of $^{2}/_{360}$ to $^{20}/_{360}$ of the circumference of the Pope roller (10) towards an area of the paper web passing through (20).

Preferably, the adhesive applicator (32) can be directed) with a distance to the nip between the Pope roller (10) and the second drum (12) of $^{70}/_{360}$ to $^{90}/_{360}$ of the circumference of the Pope roller (10) towards an area of the paper web passing through (20).

Preferably, the adhesive applicator (32) can be directed with a distance to the nip between the Pope roller (10) and the second drum (12) of $^{30}/_{360}$ to $^{50}/_{360}$ of the circumference of the Pope roller (10) towards an area of the paper web passing through (20).

Preferably, the distance to the nip between the Pope roller (10) and the second drum (12) with which the adhesive applicator (32) can be directed towards an area of the paper web passing through (20) can be adjusted between $^{2}/_{360}$ and $^{90}/_{360}$ of the circumference of the Pope roller (10).

Preferably, the device comprises a separator. The separator is preferably set up to produce a separation front which severs the web and thereby produces a web end. It is thereby possible to both produce the web end in a device and glue it to the second drum.

The separator preferably comprises a blade, a laser beam or an air jet, particularly preferably a water jet.

Preferably, the adhesive applicator is set up to apply adhesive to an adhesion area of the web end which runs along at an outer edge and/or an inner edge of the web end.

Particularly preferably, the adhesive applicator is set up to apply adhesive to an adhesion area of the web end which runs along by a separation front. It is thereby possible to use the adhesive at precisely the spots where it is needed. Particularly preferably, the adhesion area is at a distance from the separation front. It is thereby possible to prevent adhesive from being applied next to the web end or from spilling out next to the web end when the web end is attached to the second drum.

Preferably, the adhesive applicator is set up to apply adhesive to an area of the web or of the web end which will pass through a nip between the second drum and the Pope roller at the same time as an area of the separation front which is separated by the separator at the same time. It is thereby possible in a simple way to adapt the application of adhesive to the separation front.

BRIEF DESCRIPTION OF THE DRAWINGS

The invention is explained in more detail below with reference to the drawings.

DETAILED DESCRIPTION

Figure 1:
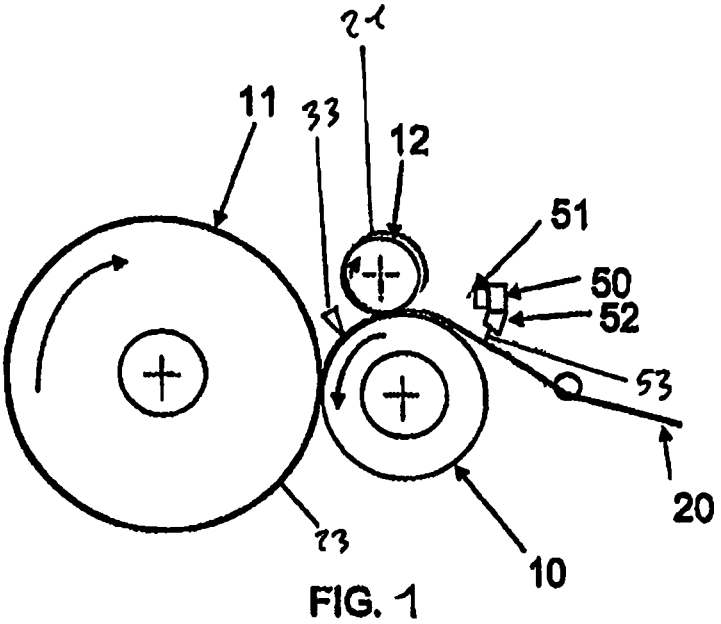
FIG. 1 shows a partial cross-section through a device for gluing a web end onto a drum with an adhesive-spraying unit.

FIG. 1 shows a partial cross-section through a device for gluing a web end on a drum. A paper web 20 runs over a Pope roller 10 onto a first drum 11.

A separator 50 with two water-jet nozzles 52 and a third water-jet nozzle 51 is positioned in front of the nip between the Pope roller 10 and a second drum 12. The water jet nozzles 52 can move transversely to the direction of travel of the paper web.

An adhesive-spraying unit 33 is positioned behind the nip between the Pope roller 10 and the second drum 12. The adhesive-spraying unit 33 is directed towards an area of the paper web 20 which is located on a downward-rotating area of the Pope roller 10.

If the paper web 20 is separated by the separator 50 in such a way that a web end 23 forms, an adhesive 2 is sprayed onto the web end 23 with the adhesive-spraying unit 33, with the result that this glues the web ends 23 to the drum 11 during winding onto the first drum 11.

Figure 2:
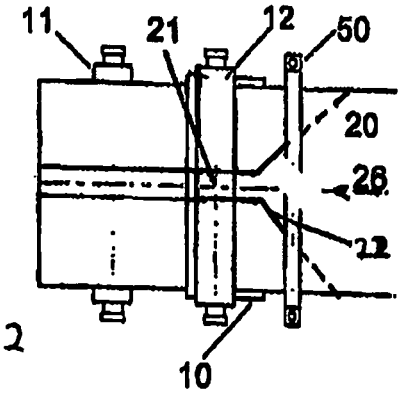
FIG. 2 shows a partial plan view of the arrangement according to FIG. 1.

FIG. 2 shows how the paper web 20 is separated in the form of a separation front 22 which first forms a narrow guide strip 21 in the centre of the paper web 20 which is widened symmetrically to the edges of the paper web 20 as the separation process continues. When the guide strip 21 is widened, the separation front 22 forms two straight lines which each run from the sides of the guide strip 21 to the edges of the paper web 20. The guide strip 21 here is partly wound onto the second drum 12. Thus the guide strip 21 is missing from the first drum.

The separation front 22 is produced by means of two water jets 53', 53" (seen here in side view as one water jet 53) of the separator 50, as shown in FIG. 1. The two water jets 53' and 53" are first kept at a short distance from each other, in order to produce the guide strip 21. After the guide strip 21 has been produced, the distance between the two water jets 53' and 53" is increased, until they have been led to the edges of the paper web 20 and have in this way severed the paper web 20 completely. A two-part web end 23 thereby results. If the guide strip 21 is severed, two parts of the guide strip 21 form. One of the two parts lies on the side of the first drum, the second part of the guide strip 21 lies on the side of the second drum. If the rotation of the first drum 11 slows down, the web end 23 and the part of the guide strip 21 which lies on the side of the first drum 11 can damage the paper web 20 or remnants can tear due to the centrifugal forces and enter the nip of the second drum 12. To prevent this, the web end 23 and the part of the guide strip 21 which lies on the side of the first drum 11 are glued fast with adhesive 2 by the adhesive-spraying unit 33 shown in FIG. 1.

FIGS. 3*a*-3*e* show, on the left, a partial cross-section in schematic representation and, on the right, a partial plan view of a device for gluing a web end on a drum and represent different variants for the application of the adhesive.

Figure 3A:
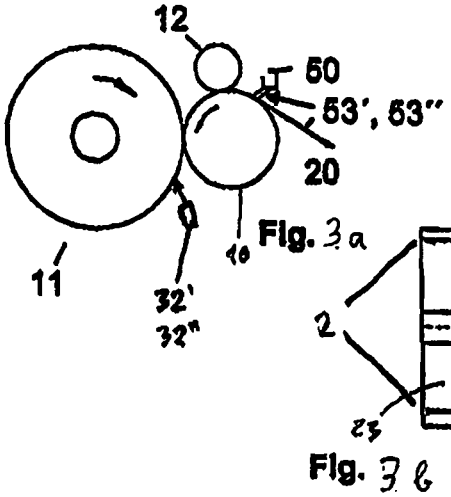
FIGS. 3*a*-3*e* show a partial cross-section in schematic representation and a partial plan view of a device for gluing a web end onto a drum and represent different variants for the application of the adhesive.

FIG. 3*a* shows a schematic cross-section view of the device for gluing a web end on a drum with adhesive-spraying units 32' and 32". The adhesive-spraying units 32' and 32" are positioned by the first drum 11 below the Pope roller 10 in the downward-rotating area. The adhesive 2 is added at a distance to the nip of the first drum 11 which corresponds to the distance from the high-pressure water-cutting jet (which is closest to the second drum 12) to the nip of the first drum 11. When changing the paper web 20 onto the second drum 12, a two-part web end 23 forms. The application of the adhesive 2 to the first drum 11 ensures that the web ends 23 are wound smoothly onto the first drum 11.

The adhesive is a water-soluble, fast-acting adhesive with a high adhesive strength in order that a small metered dose holds the two-part web end 23 on the first drum 11. This adhesive can be dissolved in the dissolver. The adhesive does not become more concentrated over time. The adhesive does not leave any spots or stains on the paper. The adhesive-based holding system is cheaper than mechanical systems which smooth the web with rollers or brushes as the first drum rotates in order to prevent air from entering.

Figure 3B:
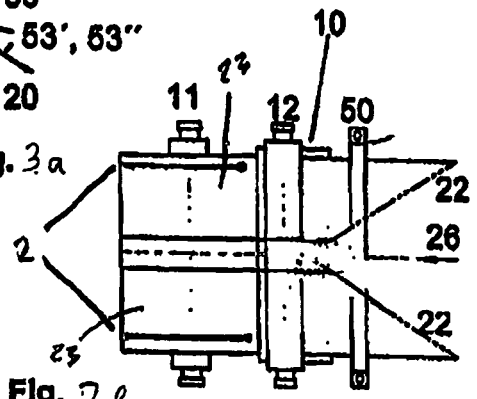

FIG. 3*b* shows, in a schematic plan view of the device shown in FIG. 3*a* for gluing a web end on a drum, a possibility for applying the adhesive 2 to the two-part web end 23. The adhesive 2 is here applied to the two-part web end 23 adjacent to the two edges of the paper web 20.

The web end 23 can thereby be particularly effectively glued to the first drum 11, since an optimum amount of adhesive 2 is used in this way.

Figure 3C:
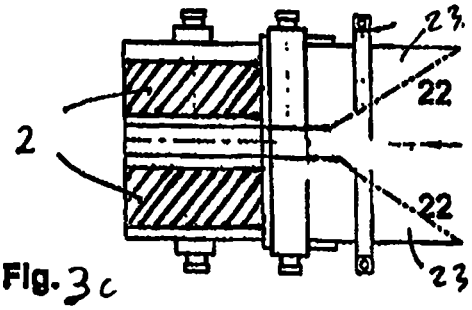

FIG. 3*c* shows, in a schematic plan view of the device shown in FIG. 3*a* for gluing a web end on a drum, a further possibility for applying the adhesive 2 to the web end. The adhesive 2 is here applied extensively to virtually the whole of the web end 23. The web end 23 is thereby glued particularly securely to the first drum 11. The spraying-on of the adhesive 2 is adapted to the shape of the narrowing web end 23. An excess of adhesive 2 is thereby avoided, so as not to touch the surface of the Pope roller 10 that is becoming free.

Figure 3D:
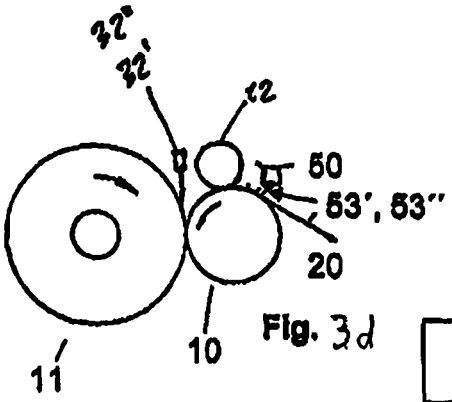

FIG. 3*d* shows a schematic cross-section view of the device for gluing a web end on a drum with adhesive-spraying units 32' and 32". The adhesive-spraying units 32' and 32" are positioned by the first drum 11 above the Pope roller 10. They are directed towards a downward-rotating area of the first drum 11. It is thereby possible to apply adhesive 2 to the paper web 20 in such a way that it is immediately covered by the paper web 20.

Figure 3E:
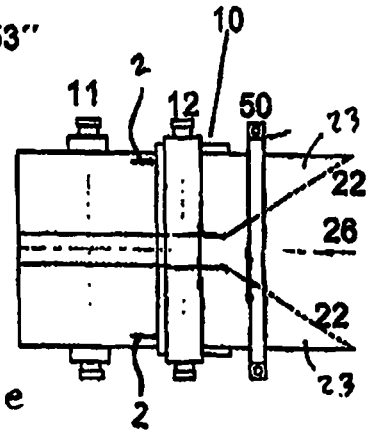

FIG. 3*e* shows, in a schematic plan view of the device shown in FIG. 3*d* for gluing a web end on a drum, a further possibility for applying the adhesive 2 to the web end 23. The adhesive is here applied to the web end 23 adjacent to the outer edges of the paper web 20.

Figure 4A:
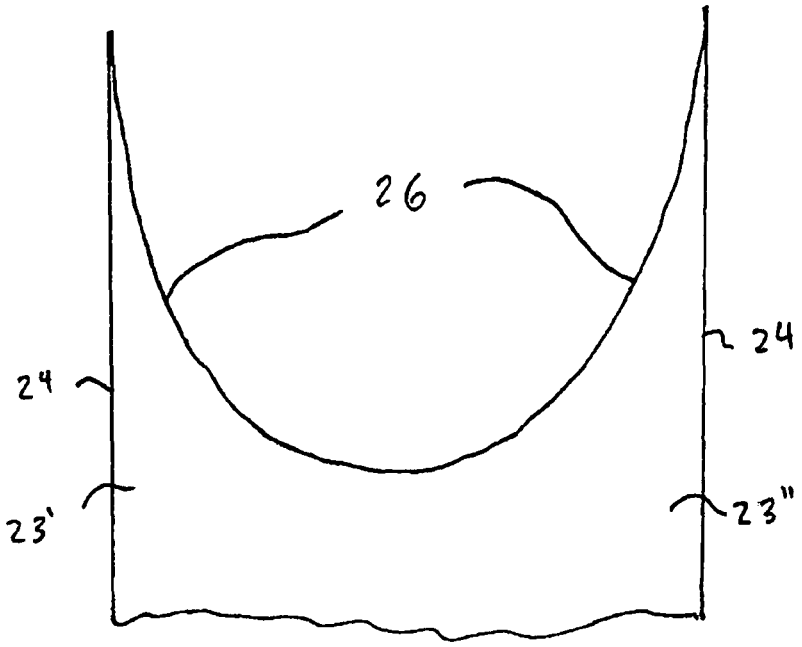
FIGS. 4*a*, 4*b* show variants for the design of the separation front.
Figure 4B:
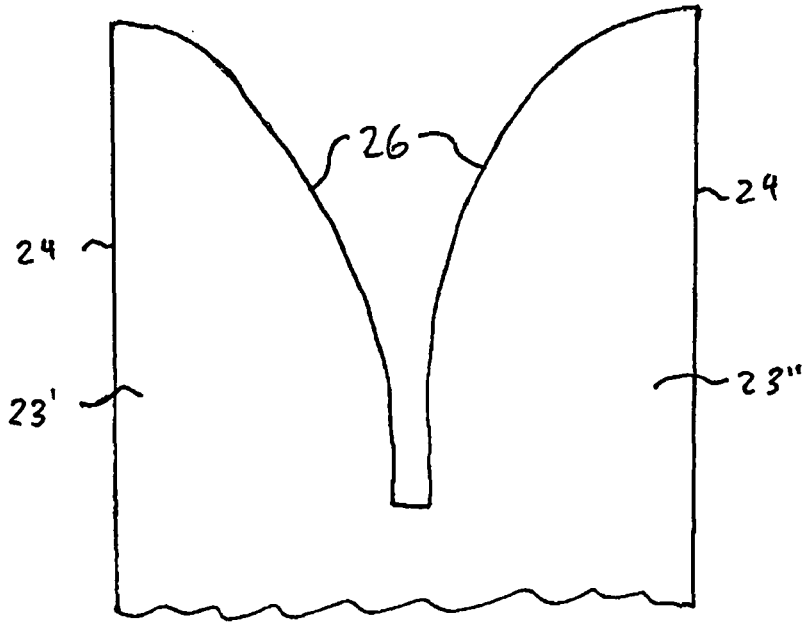

FIGS. 4*a*, 4*b* show variants for the design of the separation edge 26.

In FIG. 4*a*, a separation edge 26 is shown which has been produced by the water jet nozzles 52 having been guided outwards, quickly at first and then more slowly.

In FIG. 4*b*, a separation edge 26 is shown which has been produced by the water jet nozzles 52 having been guided outwards, firstly not at all, then slowly and then more quickly.

FIGS. 5*a*-5*d* show further variants for the application of the adhesive 2. In each case, a two-part web end 23' and 23" is shown, to which an adhesive 2 has been applied. The two-part web end 23' and 23" comprises strips that are symmetrical to each other. The two-part web end 23' and 23" has two outer edges 24, two inner edges 25 and two separation edges 26, which extend diagonally from the respective inner edge 25 to the respective outer edge 24. The separation edges 26 run in such a way that they form an acute angle with the outer edges 24 and an obtuse angle with the inner edges 25.

Figure 5A:
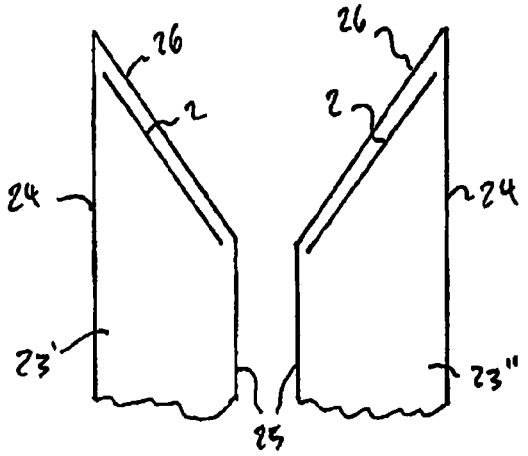
FIGS. 5*a*-5*e* show further variants for the application of the adhesive.

In FIG. 5*a*, the adhesive 2 is applied to the two-part web end 23' and 23" in each case in the form of a line parallel to the separation edges 26. The adhesive is at a distance both from the separation edges 26 and from the outer edges 24 and the inner edges 25.

Because the adhesive 2 is applied parallel to the separation edges 26, the adhesion spot has a spiral shape and glues the two-part web end 23' and 23" at all points in time of the gluing in the respectively critical area which could come loose. Because the adhesive 2 is applied at a distance both from the separation edges 26 and from the outer edges 24 and the inner edges 25, the adhesive 2 is prevented from reaching components or areas of the paper web 20 on which it is not desired.

Figure 5B:
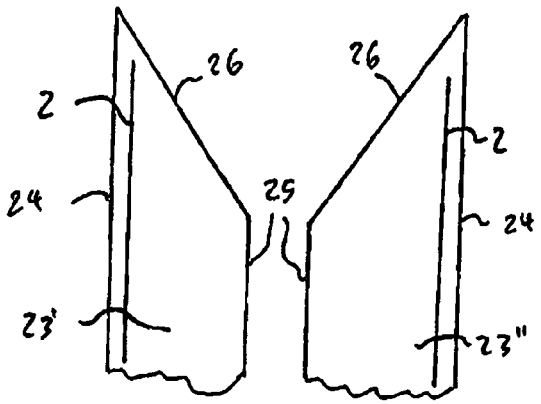

In FIG. 5*b*, the adhesive 2 is applied to the two-part web end 23' and 23" in each case in the form of a line parallel to the outer edges 24.

Because the adhesive 2 is applied in the form of a line parallel to the outer edges 24, a lateral displacement of the two-part web end 23' and 23" is effectively prevented.

Figure 5C:
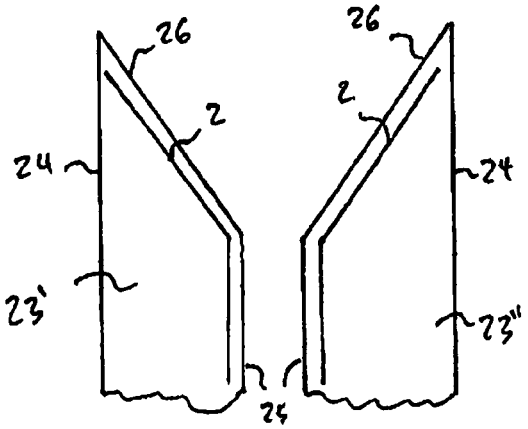

In FIG. 5*c*, the adhesive 2 is applied to the two-part web end 23' and 23" in each case in the form of a line parallel to the inner edges 25 and the separation edges 26.

Because the adhesive 2 is applied in addition to the area described in FIG. 5*a* parallel to the inner edges 25, a lateral displacement of the two-part web end 23' and 23" is even more effectively prevented.

Figure 5D:
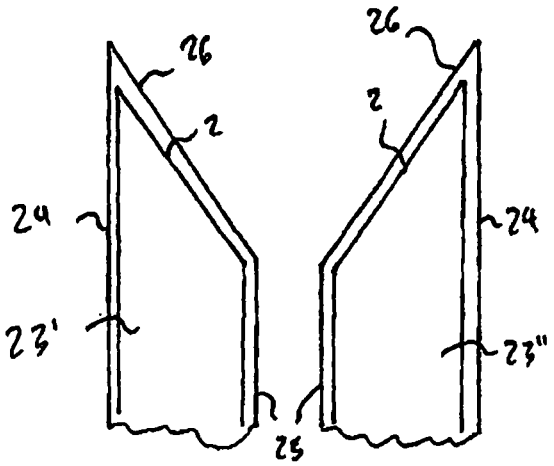

In FIG. 5*d*, the adhesive 2 is applied to the two-part web end 23' and 23" in each case in the form of a line parallel to the inner edges 25, the outer edges 24 and the separation edges 26.

Because the adhesive 2 is applied parallel both to the separation edges 26 and to the inner edges 25 and the outer edges 24, a slippage of the two-part web end 23' and 23" is particularly securely prevented.

Figure 5E:
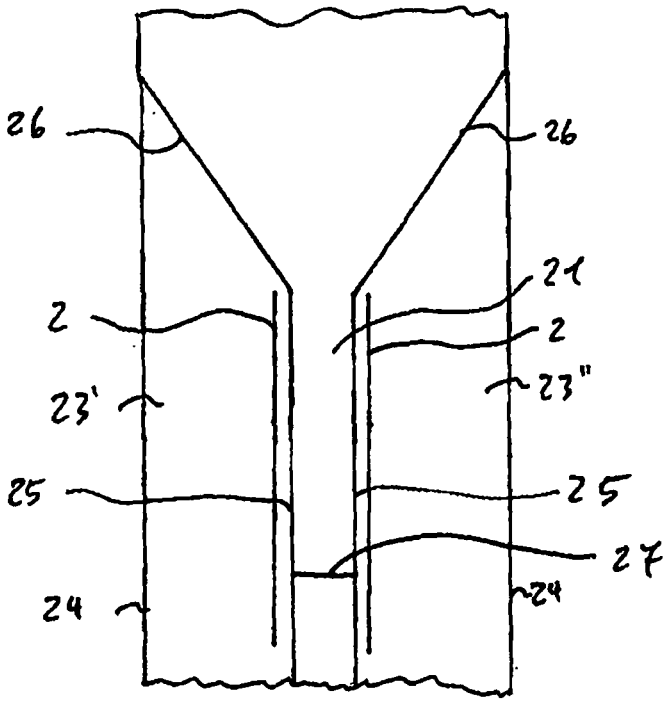

In FIG. 5*e*, the adhesive 2 is applied to the two-part web end 23' and 23" in each case in the form of a line parallel to the inner edges 25. The adhesive 2 is applied at a distance both from the outer edges 24 and from the separation edges 26 and the inner edges 25.

In FIG. 5*e*, the guide strip 21 is also shown. This lies between the inner edges 25 and the separation edges 26 of the two-part web end 23' and 23".

LIST OF REFERENCE NUMBERS

2 adhesive
10 Pope roller
11 first drum (mother roll)
12 second drum
20 paper web
21 guide strip
22 separation front
23 web end
24 outer edge
25 inner edge
26 separation edge
32 adhesive-spraying unit
33 adhesive-spraying unit
50 separator
51 third water-jet nozzle
52 water jet nozzle
53 water jet, beam

The invention claimed is:

1. A method for making paper in a paper making machine comprising securing a web end of a paper web on a first drum during a change of drum from the first drum to a second drum, the method comprising severing the paper web so as to form the web end before a first nip between a Pope roller and the second drum;

passing the web end through the first nip, the web end being adhesive-free when it passes through the first nip; and applying adhesive into a region adjacent a second nip between the Pope roller and the first drum in such a way that the adhesive is applied to a first area of the paper web and a second area of the paper web immediately covers the adhesive during winding of said first and second areas of the paper web onto the first drum, one of said first and second areas of the paper web being the web end that is being secured to the first drum;

wherein the severing of the paper web is performed simultaneously with the applying of the adhesive and the adhesive is located along the web end as the web end is wound onto the first drum such that the web end sticks to the first drum.

2. The method as recited in claim 1, wherein the applying is performed at an angle of impact of 1° to 30°.

3. The method as recited, in claim 1, wherein the applying is performed at an angle of impact of 150° to 179°.

4. The method as recited in claim 1, wherein the applying is performed at an angle of impact of 80° to 100°.

5. The method as recited in claim 1, wherein the applying is performed at a distance to the first nip of $^{2}/_{360}$ to $^{90}/_{360}$ of the circumference of the Pope roller.

6. The method as recited in claim 1, wherein the applying is performed at a distance to the first nip of $^{2}/_{360}$ to $^{20}/_{360}$ of the circumference of the Pope roller.

7. The method as recited in claim 1, wherein the applying is performed at a distance to the first nip of $^{70}/_{360}$ to $^{90}/_{360}$ of the circumference of the Pope roller.

8. The method as recited in claim 1, wherein the applying is performed at a distance to the first nip of $^{30}/_{360}$ to $^{50}/_{360}$ of the circumference of the Pope roller.

9. The method as recited in claim 1, wherein the severing of the paper web includes introducing a first separation mark running from a central area to a first outer edge of the web and a second separation mark running from the central area to a second outer edge of the web.

10. The method as recited in claim 1, where the applying of adhesive to the papa web comprises applying adhesive to an area of the paper web that is on the Pope roller.

* * * * *